US005101566A

United States Patent [19]

Crapo et al.

[11] Patent Number: 5,101,566

[45] Date of Patent: Apr. 7, 1992

[54] TOOL FOR PUNCHING WEEP HOLES IN WINDOW SILL CANS

[75] Inventors: Larry J. Crapo, Portland; Mitchell L. Vogt, Forest Grove, both of Oreg.

[73] Assignee: Mitch Vogt, Tigard, Oreg.

[21] Appl. No.: 619,756

[22] Filed: Nov. 13, 1990

[51] Int. Cl.[5] ..... B26F 1/00

[52] U.S. Cl. ..... 30/363; 30/358

[58] Field of Search ..... 30/251, 363, 358, 229, 30/190, 192

[56] References Cited

U.S. PATENT DOCUMENTS

| | | | |
|---|---|---|---|
| 1,229,213 | 6/1917 | Bernard | 30/363 |
| 1,679,039 | 7/1928 | Kucera | 30/363 |
| 1,962,193 | 6/1934 | Heise | 30/363 |
| 4,255,857 | 3/1981 | Foley | 30/229 |
| 4,291,464 | 9/1981 | Garrett | 30/363 |
| 4,599,795 | 7/1986 | Yokoyama | 30/192 |
| 4,707,924 | 11/1987 | Burney | 30/363 |
| 4,910,870 | 3/1990 | Chang | 30/192 |

*Primary Examiner*—Frank T. Yost
*Assistant Examiner*—Hwei-Siu Payer
*Attorney, Agent, or Firm*—Robert L. Harrington

[57] ABSTRACT

A punching tool for producing weep holes in a sill can utilized for window installations is disclosed. The tool has pivotally mounted jaws operable by a handle assembly with a punch formed flush with an end of a first jaw and a die opening provided in an end of a opposed second jaw. The pivotal connection of the jaws maintains the punch and die opening in arcuate alignment as the jaws are pivoted. A throat of the tool receives the upstanding leg of the sill can with the formed punch fitting flush against the bottom of the sill can and thus the tool will produce a weep hole in the upstanding leg flush with the interior bottom of the sill can as the jaws are pivoted toward each other. A large surface area surrounding the die opening in the second jaw prevents marring of the sill can exterior surface.

2 Claims, 2 Drawing Sheets

TOOL FOR PUNCHING WEEP HOLES IN WINDOW SILL CANS

BACKGROUND INFORMATION

1. Field of the Invention

This invention relates to hand tools for the construction trades and in particular it relates to a manually operated tool for producing weep holes in sill cans utilized for window installations.

2. Background of the Invention

Exterior glass in commercial or high rise buildings is installed in the curtain walls of the structure. The curtain walls have window openings, referred to as rough openings, for the installation of the windows. A framework is provided, the rough openings which retain and hold the windows in position.

The framework includes vertical jambs for each end of the rough opening, a headcan for the top of the rough opening and a base, referred to as a sill can for the bottom of the opening.

The sill can is a "U" shaped member, generally of extruded aluminum that is either pre-painted or anodized. The sill can is installed on the bottom of the rough opening with the legs of the "U" extending upward, thus forming a channel for the glass to be set in.

Most of the windows installed on buildings that are exposed to the weather are of the multiple plate (pane) type. The windows have two or more glass plates separated by an air gap. The multiple plates are factory assembled on a frame that holds the plates in a spaced relation and also seals the air gap between adjacent plates.

The glass is set in the sill can with the frame of the window abutted against or in close proximity to the exterior upstanding leg of the sill can. Although sealing materials are utilized, an absolute water tight seal is not obtained between the sill can and the glass. It is possible for water to enter between the glass and the sill can and accumulate in the upright "U" of the sill can. It is therefore necessary to provide slots or openings, referred to as weep holes, in the sill can for the drainage of any accumulated water.

The sill can is cut to length to fit the rough opening and therefore the weep holes are produced at the time of the window installation. Weep holes are placed adjacent the end vertical jamb and if multiple lites are installed in an opening, weep holes are provided in the sill can on each side of the vertical mullions that act as glass dividers. The vertical mullions enter into the channel of the "U" which would trap any accumulated water and thus weep holes are required in the sill can on both sides of any vertical window divider.

The weep holes were produced by drilling holes in the exterior upstanding leg of the sill can with portable hand drills. The holes were to be placed so that the bottom of the drilled holes were flush with the interior bottom of the sill can to facilitate complete water drainage. It was preferable to have the weep hole in the shape of an elongate slot. To produce the slot, at least two holes were drilled at a distance from each other, and the material between the holes was removed by forcing the drill sideways from one drilled hole to the other.

The manual drilling operation produced slots of varying size and were often not properly positioned in reference to the internal bottom of the sill can. Also the drilling operation often left undesirable burrs, the material surface of the sill can was scratched or gouged, and it was a time consuming procedure.

BRIEF SUMMARY OF THE INVENTION

The present invention is a manually operated punching tool for producing weep holes in a sill can. The tool produces a shaped slot utilized to drain any accumulated water in the sill can.

The tool will, in a single operating stroke, produce a weep hole without burrs or damage to the surrounding material. The ease of usage of the tool provides for rapid and accurate hole placement.

The tool of the present invention has opposed pivotally mounted jaws that have a throat of sufficient length to accept the leg of the window sill can. One of the jaws has a formed punch and the other jaw has a formed die. Operating handles pivot the jaws toward each other to punch out a slug of material to form the weep hole in the upstanding leg of the sill can.

The punch is configured to operate flush with the internal bottom of the sill can, thus producing the weep hole flush with the internal bottom of the sill can.

A large surface area surrounding the shaped die prevents marring of the external surface of the sill can during the punching operation.

Other objects and advantages will be realized from the following drawing figures and the detailed description.

DESCRIPTION OF THE PREFERRED EMBODIMENT

Figure 5:
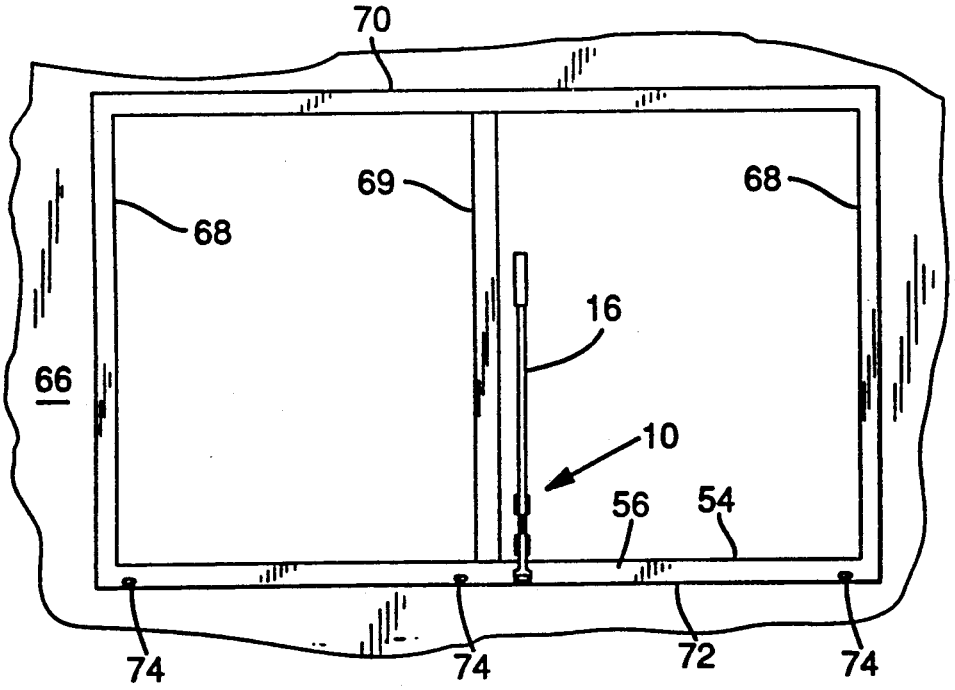
FIG. 5 is a view of a wall of a building having a rough opening for a window installation.

Windows are installed in rough openings 64 provided in the walls 66 of a building. FIG. 5 shows a rough opening 64 in a wall 66 for a window installation and has framework installed for retaining and supporting glass. The framework includes vertical jambs 68, a headcan 70, a vertical mullion 69 and a sill can 54. The sill can 54 is the supporting base member of the framework installed in the opening 64. The sill can 54 (see FIG. 2) is a "U" shaped member having a bottom 58 also referred to as a web, and upstanding legs 56 and 57. The sill can is installed on the base 72 of the opening with legs 56 and 57 of the "U" shaped sill can 54 extended upward. When the glass is installed, the glass is set in the channel formed by the upstanding legs 56 and 57. It is possible for water to enter between the window and the leg 56 exposed to the weather so weep holes 74 must be provided in the external leg 56 of the sill can 54 for water drainage. In order to drain all accumulated water, it is important for the weep holes 74 to be flush with the interior bottom of the sill can 54. Although FIG. 5 illustrates a rough opening for the installation of multiple windows, with a vertical mullion 69 installed to separate the windows, it is common to have a single window installed in the opening. The opening then normally has vertical jambs 68 at the ends only.

Also shown in FIG. 5 is the punching tool 10 utilized to produce the weep holes 74. The tool 10 is positioned to punch a weep hole 74 in the leg 56 in close proximity to the vertical mullion 69.

Figure 1:
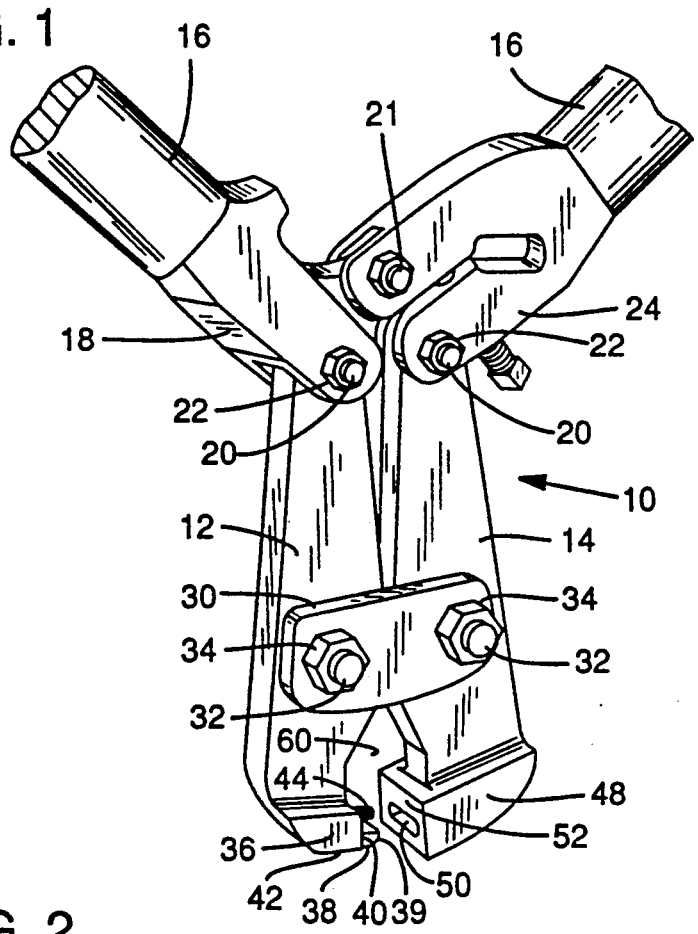
FIG. 1 is a perspective view of the tool of the present invention.

Refer now to FIG. 1 of the drawings. It shows in perspective view a preferred embodiment of a manually operated punching tool 10 for producing weep holes in "U" shaped sill cans. The tool 10 has opposed jaws 12 and 14 that are pivotally mounted to the operating handle assembly 16. The handle assembly 16 is a compound leverage type of known design and therefore will not be detailed. One end of the jaw 12 is pivotally mounted in the clevis of the clevis arm 18 of the handle assembly 16 by a threaded fastener 20 and nut 22. The jaw 14 is pivotally mounted in the clevis of the clevis arm 24 of the handle assembly 16 by a another fastener 20 and nut 22.

Figure 2:
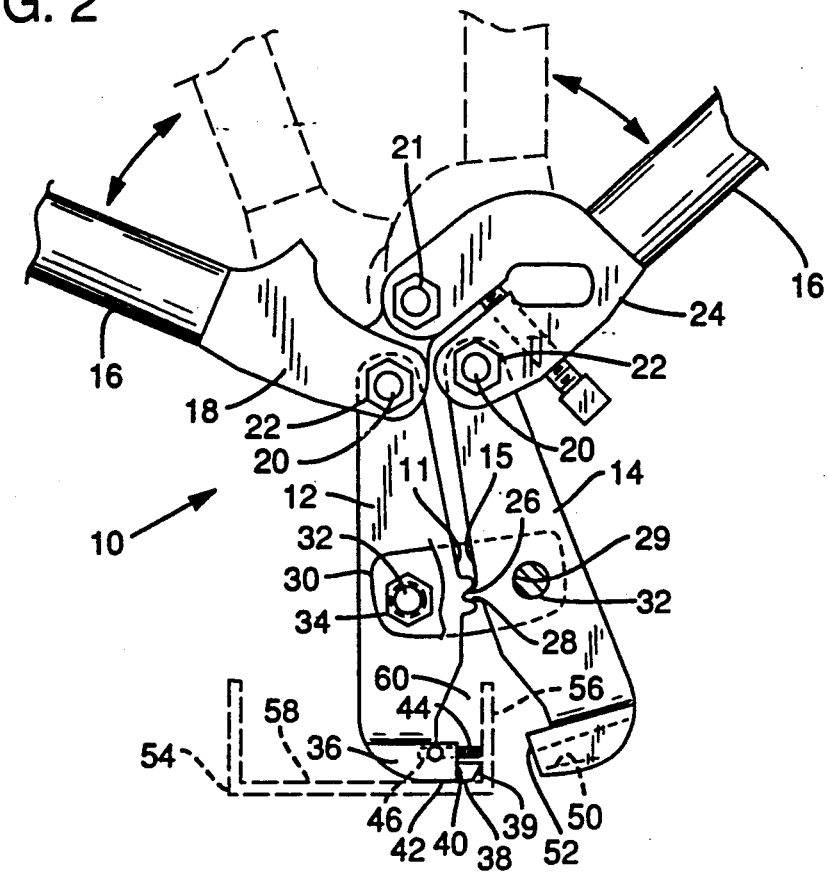
FIG. 2 is a view of the tool showing the initial position of the tool placed on a member to be punched.

Referring now also to FIG. 2 (wherein portions are removed for illustration purposes), the jaw 12 has an involute gear segment 26 formed on the surface of an edge 11 that is mesh with an involute gear segment 28 formed on the surface of an edge 15 of the jaw 14. In this embodiment the gear segment 26 on jaw 12 has two gear teeth and the gear segment 28 on jaw 14 has a single gear tooth. A bore 27 is provided in jaw 12 that is preferably at the gear segment 26 center and a bore 29 is provided in jaw 14 that is preferably at the gear segment 28 center. The gear segments are held in mesh by a pair of tie bars 30 having suitable bores for mounting. One tie bar 30 is mounted on one side of the jaws 12 and 14 and the other tie bar is mounted on the other side of the jaws 12 and 14 by threaded fasteners 32. One of the fasteners is fitted in the bores of the tie bars 30 aligned with the bore 27 of the jaw 12 and another fastener 32 is fitted in the bores of the tie bars 30 aligned with the bore 29 of the jaw 14, and, as shown in FIG. 1, the fasteners are secured by retaining nuts 34.

The axis of the bore 27 is the pivot axis for jaw 12 and the axis of the bore 29 is the pivot axis of the jaw 14. The tie bars 30 and the meshed gear segments 26 and 28 cooperatively maintain the jaws 12 and 14 in alignment. As the jaws 12 and 14 are pivoted on their pivot axes 27 and 29, the head 36 of the jaw 12 and head 48 of the jaw 14 will travel on an aligned arcuate path.

Figure 3:
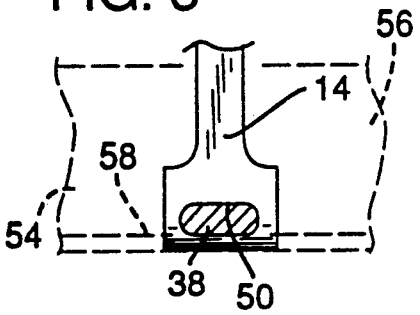
FIG. 3 is a view of the tool as viewed on view lines 3—3 of FIG. 4.
Figure 4:
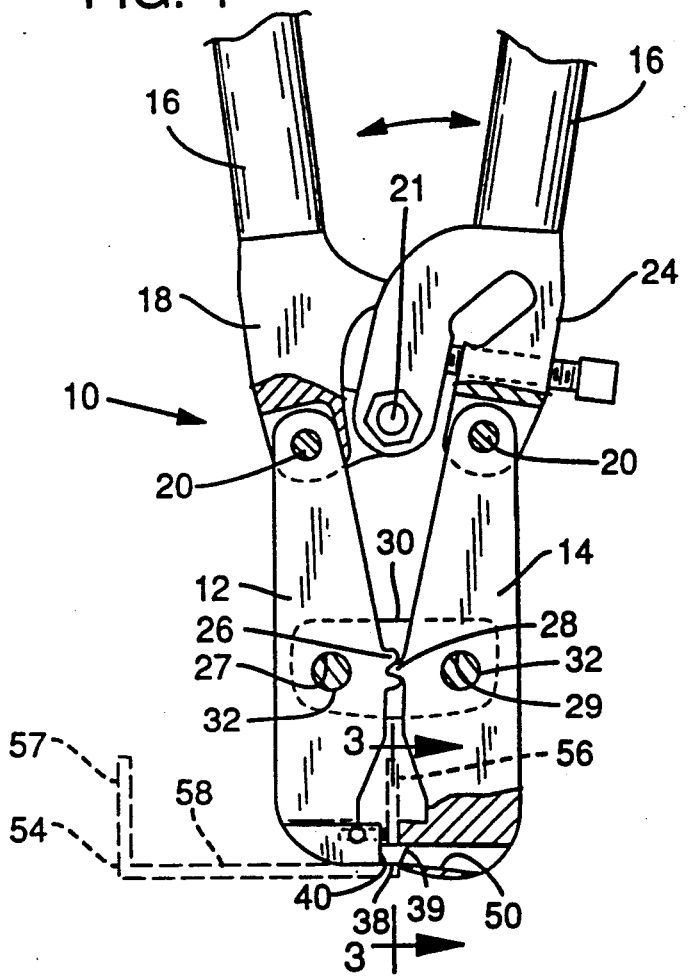
FIG. 4 is a view of the tool after the punching operation with the punch having entered the die and a slug removed from the member.

The head, generally indicated by numeral 36, of the jaw 12 as shown in FIGS. 1 and 2 has a formed male punch 38. The punch 38 is a shaped member that extends from the face 40 of the head 36 and is flush with the end 42. The end 39 of the punch 38 as shown in FIGS. 2 and 4 has a suitable rake angle as in conventional punch and die practice. As shown in FIG. 3, the cross section of the punch 38 is an elongate member having radiused ends. The cross section of the punch 38 corresponds to the shape of the weep hole 74 produced.

A spring biased plunger assembly 44 is threadably installed in a threaded bore 46 in the face 40 of the head 36 adjacent the punch 38. The plunger of the assembly 44 is yieldably biased in an outward direction from the face 40 of the head 36.

The opposite or opposed head, generally indicated by numeral 48, of the jaw 14 has a formed female die 50 of a shape and dimension commencing at the surface 52 to receive the punch 38 of the jaw 12. The die 50 extends through the head 48 and increases in cross sectional area as in conventional punch and die practice.

The punch 38 and the die 50 are in arcuate alignment as the jaws 12 and 14 are pivoted on the fasteners 32 fitted in the bores 27 and 29, the jaws 12 and 14 being geared to each other by the gear segments 26 and 28. The area between the jaws 12 and 14 generally indicated by the numeral 60 and as extended between the jaws to the bars 30, is referenced to as the throat of the tool 10. When the heads of the jaws 12 and 14 are pivoted in a direction away from each other, an entry or opening to the throat 60 is obtained.

OPERATION

To produce a weep hole utilizing the tool 10, the handles of the handle assembly 16 are pivoted away from each other (on the axis of the fastener 21) which pivots the clevis arms 18 and 24 away from each other. The jaws 12 and 14 pivotally mounted in the clevis arms will thus pivot on the pivot axes 27 and 29 thus moving the punch 38 and die 50 away from each other thus providing an opening to the throat 60.

The tool 10, as shown in FIG. 2, is placed on the sill can 54 at the position where a weep hole is desired with the upstanding leg 56 entering the throat 60. The end 42 (and thus the punch 38) of the jaw 12 fits flush against the bottom 58 of the sill can 54.

The operating handles of the tool 10 are pivoted toward each other, which pivots the jaws 12 and 14 toward each other causing the punch 38 to abut against the internal wall of the leg 56 and the surface 52 surrounding the die 50 to abut the external wall of the leg 56. Note from FIG. 4 that the surface 52 is flush against the outer wall of the leg 56 as the punch 38 engages and pierces the inner wall of the leg 56. The large surface area of the surface 52 prevents any marring of the external surface of the outer wall of the leg 56 of the sill can. Continued pivoting of the handles toward each other, as shown in FIG. 4, will cause the punch 38 in conjunction with the die 50 to punch out a slug of material to produce the weep hole. The slug of material is ejected through the die 50. As shown in FIG. 4, as the punch 38 punches out the slug of material and enters the die 50, the plunger of the plunger assembly 44 is forced into the head 36 of the jaw 12. This produces a biasing force that aids in ejecting the punch 38 from the newly formed weep hole. The handles are pivoted away from each other thus pivoting the jaws 12 and 14 away from each other permitting the punch to exit the weep hole. The tool may now be moved to the next position where a weep hole is desired. The tool 10, in one simple operating step produces a weep hole of desired shape that is flush with the bottom 58 of the sill can 54.

It will be apparent to those skilled in the art that modifications and variations may be made without departing from the true spirit of the invention. The shape of the punch and die for example may have other forms such as square, rectangular, parallelogram and others. Other means may be used to pivot the jaws toward each other to produce the punching action. The scope of the invention is therefore not to be limited to the drawings and description but is to be determined by the appended claims.

What is claimed is:

1. A punching tool for punching weep holes in a supporting member for window installations, said supporting member being "U" shaped with a pair of vertical legs and a horizontal connecting web forming a channel having a flat bottom wall, the juncture between the web and legs forming corners, said tool comprising:

a first jaw having a head end and a second jaw having a head end, and a handle assembly that is operable to move the head ends of said first and second jaws toward and away from each other, a punch formed on the head end of the first jaw and a flat face formed on the head end of the second jaw and a die opening formed in said flat face, the movement of the head ends toward each other projecting the punch into the die opening, and said movement of the punch at the point of entry into the die opening defining a path of movement, said punch positioned at the extreme outer end of the head end of the first jaw to enable the punch to be placed against the bottom wall for projection thereof into the corner of the channel, and said die opening and said punch having configurations that are the same whereby movement of the jaws toward each other severs and removes a wall segment to form a hole through the leg of said member at said corner providing a weep hole flush with the channel bottom wall.

2. A punching tool for punching weep holes in a supporting member as defined in claim 1, wherein:

said punch is shaped to have bottom edge that is linear in part whereby the punched weep hole has a corresponding linear bottom edge extended along said corner to facilitate draining said channel.

* * * * *